US008448477B2

(12) United States Patent
Ashrafzadeh et al.

(10) Patent No.: US 8,448,477 B2
(45) Date of Patent: May 28, 2013

(54) LAUNDRY TREATING APPLIANCE WITH CONTROLLED RECIPROCATING MOVEMENT

(75) Inventors: Farhad Ashrafzadeh, Stevensville, MI (US); Luiz Von Dokonal, Joinville (BR); Robert J. Pinkowski, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 745 days.

(21) Appl. No.: 12/619,999

(22) Filed: Nov. 17, 2009

(65) Prior Publication Data

US 2011/0113569 A1 May 19, 2011

(51) Int. Cl.

| | |
|---|---|
| ***D06F 39/00*** | (2006.01) |
| ***D06F 29/00*** | (2006.01) |
| ***D06F 35/00*** | (2006.01) |
| ***D06F 21/00*** | (2006.01) |
| ***D06F 23/00*** | (2006.01) |
| ***D06F 25/00*** | (2006.01) |
| ***D06B 3/00*** | (2006.01) |

(52) U.S. Cl.
USPC ..... 68/12.24; 68/32; 68/140

(58) Field of Classification Search
USPC ..... 68/12.24, 32, 140
See application file for complete search history.

(56) References Cited

U.S. PATENT DOCUMENTS

| | | | | |
|---|---|---|---|---|
| 4,494,265 | A | 1/1985 | Schmidt et al. | |
| 4,718,258 | A | 1/1988 | Mason et al. | |
| 4,835,993 | A | 6/1989 | Dreher | |
| 5,090,220 | A * | 2/1992 | Fukuzawa et al. | 68/3 R |
| 6,446,473 | B1 * | 9/2002 | Park et al. | 68/156 |
| 6,615,619 | B2 | 9/2003 | Kakuda et al. | |
| 2006/0010936 | A1 | 1/2006 | Weinmann et al. | |

FOREIGN PATENT DOCUMENTS

| | | | |
|---|---|---|---|
| CN | 1710181 | A | 12/2005 |
| KR | 2001094181 | A * | 10/2001 |
| WO | 2008/061675 | A1 | 5/2008 |

* cited by examiner

*Primary Examiner* — Michael Barr
*Assistant Examiner* — Charles W Kling
(74) *Attorney, Agent, or Firm* — Peter J. Melsa; Clifton G. Green

(57) ABSTRACT

Reciprocating laundry treating appliances are disclosed. An example laundry treating appliance includes a motor to rotate a drum about the horizontal axis of rotation and an axial drive mechanism to reciprocate the drum relative to the horizontal axis of rotation. The drum may be reciprocated to distribute laundry within the drum. The rotation and reciprocation may be independent and/or simultaneous.

13 Claims, 5 Drawing Sheets

LAUNDRY TREATING APPLIANCE WITH CONTROLLED RECIPROCATING MOVEMENT

BACKGROUND OF THE INVENTION

A laundry treating appliance is a common household device for treating laundry in accordance with a preprogrammed treating cycle of operation. A subset of laundry treating appliances use a generally horizontally rotating drum to define a chamber in which the laundry is received for treatment according to the cycle of operation. The drum may be controlled to rotate at a predetermined speed in a predetermined direction as required by the cycle. Some laundry treating appliances may reverse and/or oscillate the direction of rotation in accordance with the preprogrammed cycle. The rotation of the drum may be used to impart mechanical action to the laundry, which may be attributable to the lifting and falling of the laundry as the drum is rotated and/or the relative sliding of individual laundry items.

The mechanical action associated with the horizontally rotating drum is relatively low compared to other types of laundry appliances, especially laundry machines with a drum that rotates about a vertical axis. Given that thermal action, chemical action, and mechanical action are the three primary sources of cleaning action in a laundry treating appliance, a laundry treating appliance with a relatively low mechanical action, like a horizontal axis appliance, will need to have greater thermal action and/or chemical action to obtain the same degree of cleaning as compared to a laundry treating appliance with a greater mechanical energy, like a vertical axis appliance.

BRIEF DESCRIPTION OF THE INVENTION

In one aspect, the invention is related to a laundry treating appliance and a method of operating the laundry treating appliance, the appliance has a drum for receiving laundry, a motor rotating the drum about the horizontal axis of rotation, an axial drive mechanism reciprocating the drum relative to the horizontal axis of rotation and a controller configured to control the axial reciprocation of the drum.

DESCRIPTION OF AN EMBODIMENT OF THE INVENTION

Figure 1:
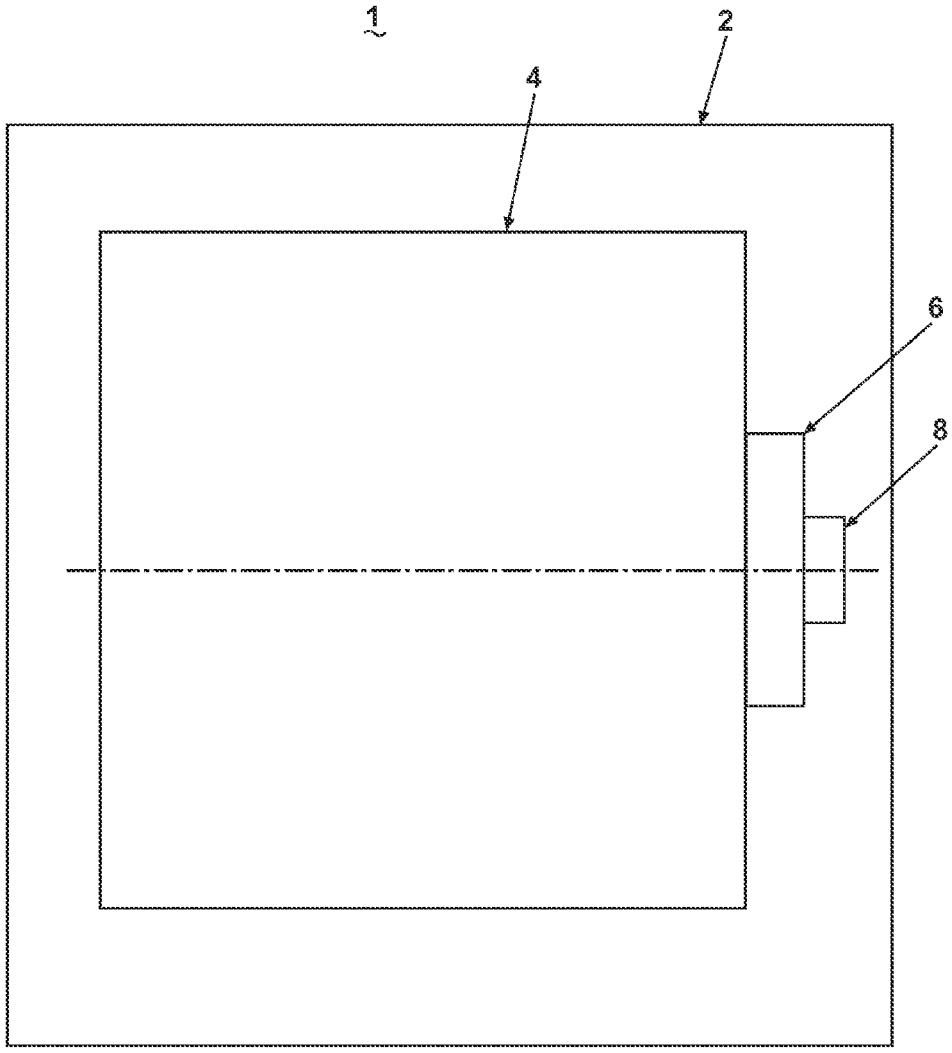
FIG. 1 is a schematic view of a laundry treating appliance according to a first embodiment of the invention.

Referring now to the figures, FIG. 1 is a schematic view of a laundry treating appliance 1 according to a first embodiment of the invention. The laundry treating appliance 1 and methods described herein may be used with any suitable laundry treating appliance, such as any machine that treats fabrics, and examples of the laundry treating appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine.

Washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. In some vertical axis washing machines, the drum rotates about a vertical axis generally perpendicular to a surface that supports the washing machine. However, the rotational axis need not be perfectly vertical or perpendicular to the surface. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be perfectly horizontal or parallel to the surface. The drum can rotate about an axis inclined relative to the horizontal axis, with fifteen degrees of inclination being one example of inclination.

For illustrative purposes, the different embodiments will be described with respect to a washing machine with the fabric being a laundry load, with it being understood that the invention may be used with other types of laundry treating appliances for treating fabric. The laundry treating appliance 1 may have a housing 2, a drum 4 rotatable in at least one of rotational directions about an axis of rotation, an axial drive mechanism 6 configured to reciprocate the drum 4 relative to the axis of rotation and a motor 8 operably coupled with the drum 4 to rotate the drum 4 at various speeds in at least one rotational direction. The axial drive mechanism 6 may be a part of the motor 8, may be couple with the motor 8 and/or may couple the motor 8 with the drum 4. The shown configuration of the laundry treating appliance 1 may axially reciprocate the drum 4 relative to the axis of rotation independently or simultaneously with the drum 4 rotation about the axis of rotation at the predetermined operating speed.

In all laundry treating appliances, including the laundry treating appliance 1, the laundry is cleaned by three main sources of action: chemical, thermal, and mechanical. Mechanical action for the horizontal axis laundry treating appliance 1 can further be divided into two components: friction associated with the fabric-to-fabric contact between moving fabric items of the laundry and the falling action associated with the tumbling of fabric items due to the rotation of the drum 4. Depending on the various characteristics of the treating appliance 1, such as the size of the drum 4, the size of the laundry load, and the control signal, the rotation of the drum 4 may result in various types of laundry load movement inside the drum 4.

While mechanical energy for a horizontal axis appliance happens primarily during the tumbling of the fabric items forming the laundry load, the movement of the laundry may have different forms, which a brief description will be useful for a general understanding. The laundry load may undergo at least one of tumbling, rolling (also called balling), sliding, satellizing (also called plastering), and combinations thereof. During tumbling, the fabric items in the drum 4 rotate with the drum 4 from a lower location of the drum 4 towards a higher location of the drum 4, and fall back toward the lower location before reaching the highest location in response to gravity. The terms tumbling, rolling, sliding and satellizing are terms of art that may be used to describe the motion of some or all of the fabric items forming the laundry load. However, not all of the fabric items forming the laundry load need exhibit the motion for the laundry load to be categorized accordingly.

Also, depending on the type and various characteristics of the treating appliance 1, the laundry treating cycle may have one or more phases: wetting, washing, rinsing, spinning, distributing, drying, revitalizing and other phases, or any combination thereof.

Figure 2:
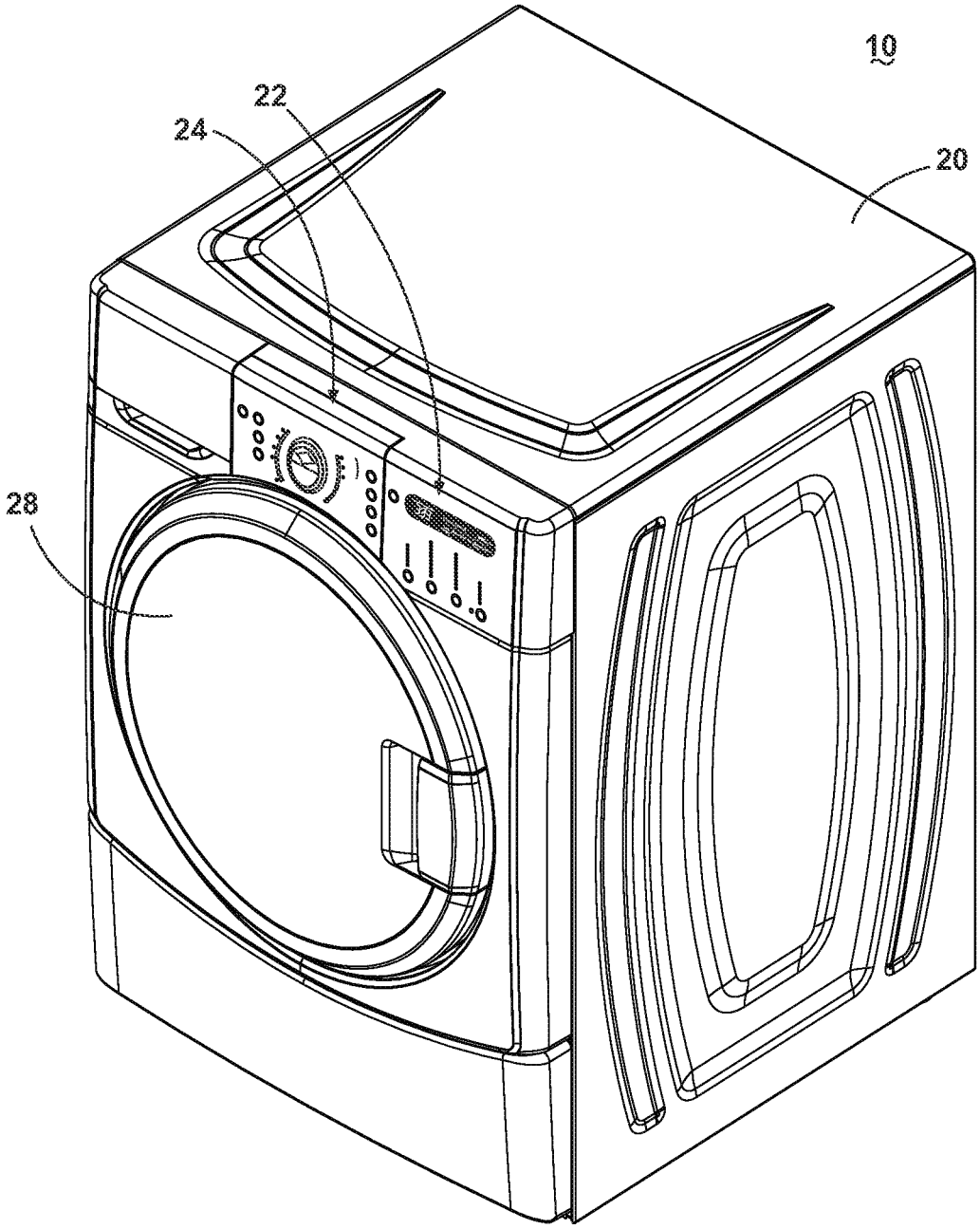
FIG. 2 is a perspective view of a laundry treating appliance in the form of a washing machine according to a second embodiment of the invention.

Referring now to FIG. 2, which is a perspective view of a laundry treating appliance in the form of a washing machine 10 according to a second embodiment, the clothes washer 10 may have a cabinet 20 in which is provided a controller 22 that may receive an input from a user and/or provide information to a user through a user interface 24 for selecting a cycle of operation, including operating parameters for the selected cycle, and controlling the operation of the clothes washer 10 to implement the selected cycle of operation.

Figure 3:
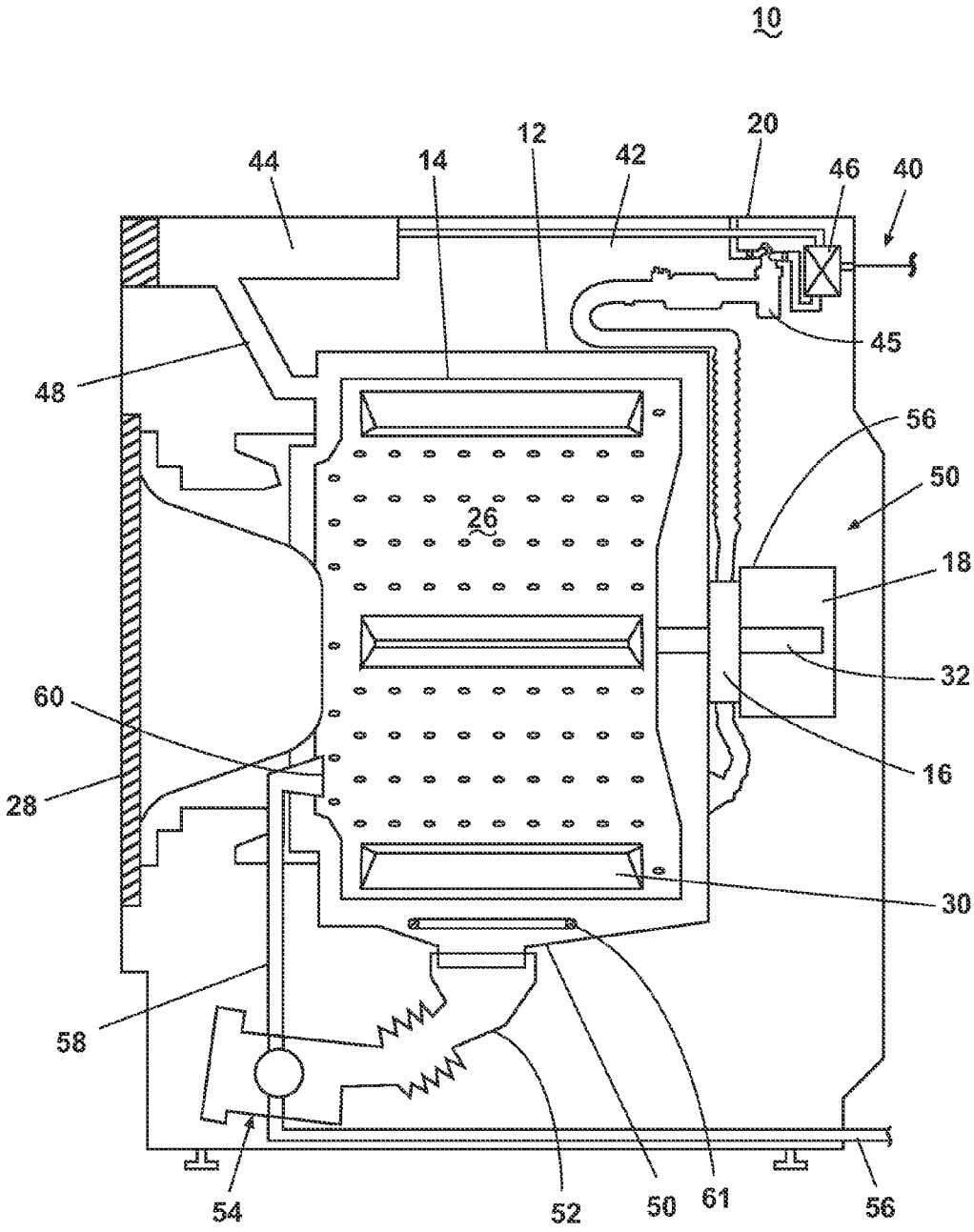
FIG. 3 is a schematic view of the washing machine of FIG. 2.

Referring now to FIG. 3, which is a schematic view of the laundry treating appliance 10 of FIG. 2, there is shown an imperforate tub 12 and a perforated drum 14 may be located within the interior of the cabinet 20. The tub 12 and the drum 14 may be mounted in the cabinet 20 such that the drum 14 can rotate relative to the tub 12. The drum 14 may define a wash chamber 26 for receiving laundry that has an open face that may be selectively closed by a door 28. The drum 14 further may have one or more baffles 30, which are sometimes referred to as lifters. The baffles 30 facilitate the tumbling action of the fabric load within the drum 14 as the drum 14 rotates about the rotational axis. Additionally, the interior surface of the drum 14 and/or the surface of the baffles 30 may be textured to increase a mutual friction between the drum 14 and laundry improving the mechanical action given to the laundry.

An automatic motor 18 may be coupled to the drum 14 via a drive shaft 32 to rotate the drum 14 at various speeds in either rotational direction. The motor 18 may be a direct drive motor, for example, a brushless permanent magnet (BPM) motor, an induction motor, a permanent split capacitor (PSC) motor, etc. Alternately, the motor 18 may be indirectly coupled with the drive shaft 32 via for example a belt, as is known in the art.

The washing machine 10 may further include a liquid supply and recirculation system. Liquid, such as wash aid, which is typically water, alone or in a mixture with other wash aids, may be supplied to the washing machine 10 from a water supply 40 in the case of water, such as a household water supply. A supply conduit 42 may fluidly couple the water supply 40 to a detergent dispenser 44. An inlet valve 46 may control flow of the liquid from the water supply 40 and through the supply conduit 42 to the detergent dispenser 44. A liquid conduit 48 may fluidly couple the detergent dispenser 44 with the tub 12. The liquid conduit 48 may couple with the tub 12 at any suitable location on the tub 12 and is shown as being coupled to a front wall of the tub 12 in FIG. 3 for exemplary purposes. The liquid that flows from the detergent dispenser 44 through the liquid conduit 48 to the tub 12 typically enters a space between the tub 12 and the drum 14 and may flow by gravity to a sump 50 formed in part by a lower portion of the tub 12. The sump 50 may also be formed by a sump conduit 52 that may fluidly couple the lower portion of the tub 12 to a pump 54. The pump 54 may direct fluid to a drain conduit 56, which may drain the liquid from the washing machine 10, or to a recirculation conduit 58, which may terminate at a recirculation inlet 60. The recirculation inlet 60 may direct the liquid from the recirculation conduit 58 into the drum 18. The recirculation inlet 60 may introduce the liquid into the drum 14 in any suitable manner, such as by spraying, dripping, or providing a steady flow of the liquid. A heating element 61 may be provided in the sump 50 to heat the liquid.

The liquid supply and recirculation system may further include one or more devices for heating the liquid; exemplary devices include sump heaters and steam generators. Additionally, the liquid supply and recirculation system may differ from the configuration shown in FIG. 3, such as by inclusion of other valves, conduits, wash aid dispensers, sensors, such as water level sensors and temperature sensors, and the like, to control the flow of liquid through the washing machine 10 and for the introduction of more than one type of detergent/wash aid. Further, the liquid supply and recirculation system need not include the recirculation portion of the system or may include other types of recirculation systems.

A steam generator 45 may be provided to supply steam to the treating chamber 26, either directly into the drum 14 or indirectly through the tub 12 as illustrated. The valve 46 may also be used to control the supply of water to the steam generator 45. The steam generator 45 is illustrated as a flow through steam generator, but may be other types, including a tank type steam generator. Alternatively, the heating element 61 may be used to generate steam in place of or in addition to the steam generator 45. The steam generator 45 is controlled by the controller 22 and may be used to heat to the laundry as part of a cycle of operation, much in the same manner as heating element 61. The steam generator 45 may also be used to introduce steam to treat the laundry as compared to merely heating the laundry.

In case of a dryer, an air flow system (not shown) is used, having a blower to first draw air across a heating element and into the drum, through a lint filter, and finally out through an exhaust conduit that is connected to an exhaust vent system leading out of the house.

Figure 4:
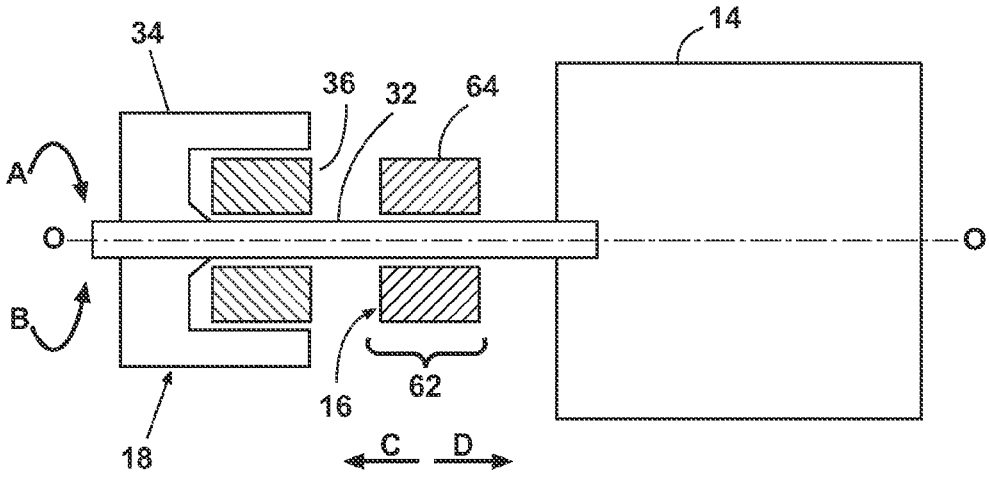
FIG. 4 is a schematic view of an axial drive mechanism and a motor according to a third embodiment of the invention.

Turning now to FIG. 4, it is illustrated a schematic view of the axial drive mechanism 16 and motor 18 according to a third embodiment of the invention. The illustrated motor 18 is a direct drive motor which may have a rotor 34 and a stator 36. The illustrated motor 18 may be coupled to the drum 14 via the drive shaft 32 and is configured to rotate the drum 14 about the axis of rotation O shown as a rotational direction A or B (better seen in FIG. 5).

The axial drive mechanism 16 according to one embodiment may be implemented as a linear drive motor 62 schematically shown as an auxiliary winding 64. As illustrated, the linear drive motor 62 may be coupled to the drum 14 via the drive shaft 32 and may be configured to reciprocate the drum 14 back and forth along the axis of rotation O shown as reciprocation directions C and D.

Figure 5:
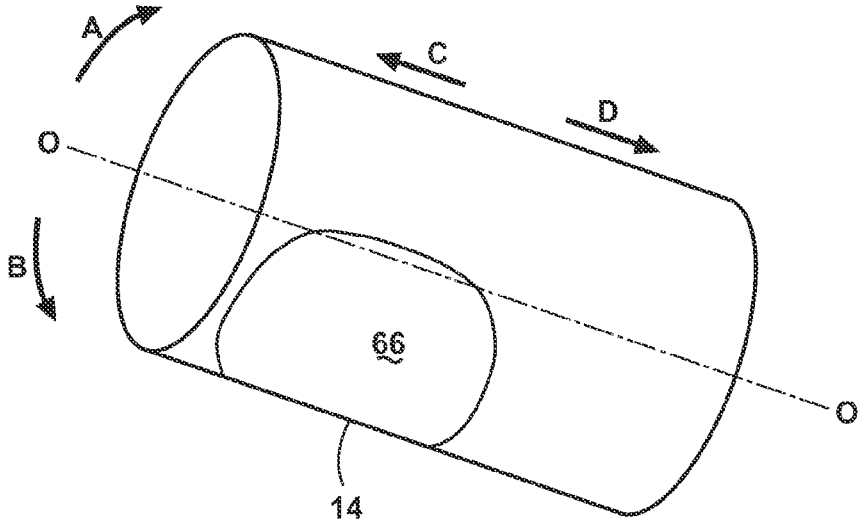
FIG. 5 is a schematic perspective view of a drum with a laundry load, illustrating the rotational directions A and B, and reciprocation directions C and D.

FIG. 5 is a schematic perspective view of the drum 14 with a laundry load 66, illustrating the rotational directions A and B, and reciprocation directions C and D.

Figure 6:
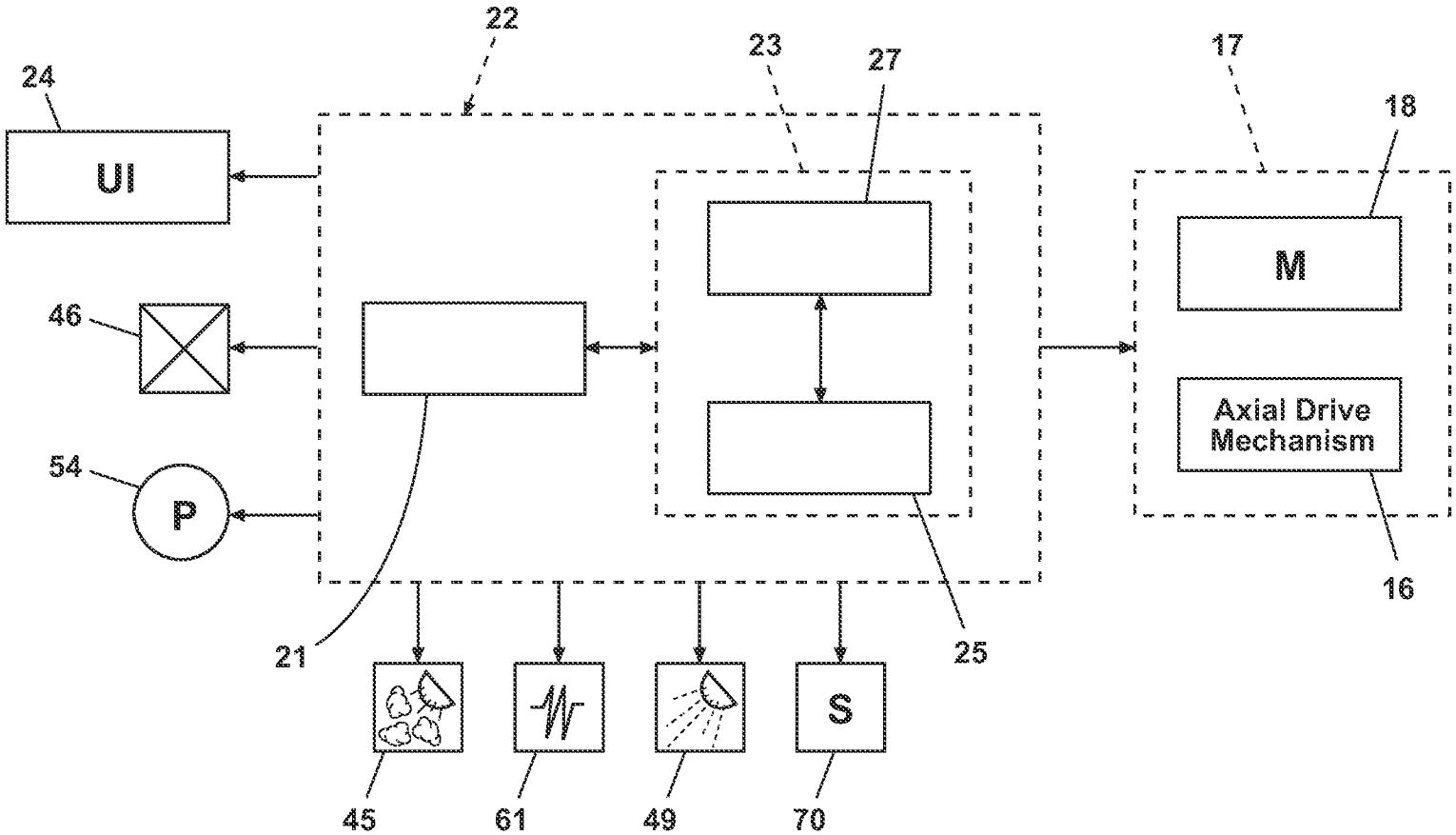
FIG. 6 is a schematic view of a control system of the laundry treating appliance of FIG. 4.

Turning now to FIG. 6, it is illustrated a schematic view of a control system of the laundry treating appliance. The controller 22 may be operably coupled with one or more components of the laundry treating appliance 10 for communicating with and controlling the operation of the component to complete a cycle of operation. For example, the controller 22 may be coupled with the treatment or detergent dispenser 44 or the steam generator 45 for dispensing a treatment during a cycle of operation; the sump heater 61 for heating the wash liquid during a cycle of operation; the valve 46 for water supply and the pump 54 for recirculation and drainage of the fluids. The controller 22 may also be coupled with the user interface 24 for receiving user selected inputs and communicating information to the user, and may also receive input from one or more sensors 70, which are known in the art and not shown for simplicity. Non-limiting examples of sensors 70 that may be communicably coupled with the controller 70 include: a temperature sensor, a moisture sensor, a weight sensor, a door sensor and a motor torque sensor.

The controller 22 may also be operably coupled with the motor 18 and the axial drive mechanism 16 and configured to independently control both the motor 18 and the axial drive mechanism 16. Alternatively, separate controllers 25 and 27 may be used to control simultaneous or independent operation of the axial drive mechanism 16 and the motor 18.

The controller 22 may be configured to supply a control signal to effect the rotation of the drum 14 about the axis of rotation O (direction A or B) at the predetermined operating speed simultaneously or independently with reciprocation of the drum 14 along the axis of rotation O (directions C and D) at a predetermined reciprocation rate. The predetermined operational speed may be, for example, a tumbling speed rotating the drum 14 at a tumbling rate.

In case of the simultaneous rotation and reciprocation, the centrifugal forces due to the rotation may keep the laundry load 66 against the interior surface of the drum 14, while axial shear forces due to reciprocation may rub the laundry load 66 against the interior surface of the drum 14. The oscillating movement of the laundry 66 cased by the reciprocation may provide a better mechanical cleaning action, especially if the interior surface of the drum 14 and/or the outer surface of the baffles 30 are textured. Additionally, the added reciprocation movement of the drum 14 may reduce the likelihood of having laundry load 66 unbalance or tangling conditions.

The reciprocation may be imposed in any combination of frequency and amplitude sufficient to cause a relative movement between adjacent fabric items and/or a relative movement between a fabric item and some structure of the appliance, such as the drum. In some instances, the resulting force will need to be great enough to overcome the corresponding frictional forces between the adjacent fabric items and/or the fabric item and a structural element. Once the static friction is overcome, the combination of the frequency and amplitude may be reduced to maintain the motion to overcome the dynamic friction. This movement enables a variety of selectable effects, some non-limiting example of which are: laundry items rubbing one against another, laundry rubbing against the internal drum surface, exiting specific frequencies where the dust/soil becomes easily extracted from the laundry. For example, the reciprocation rate may be greater than the tumbling rate, such that the frequency of drum reciprocations along the axis O is greater than the number of revolutions (i.e. revolutions per unit of time) around the axis O. The reciprocation rate may be great enough such that the axial reciprocation of the drum 14 applies the axial shear force to the laundry having a magnitude greater than the frictional force between the laundry and the drum 14, hereinafter referred to as a sliding rate. Reciprocating at the sliding rate may also be useful for an active redistribution of the laundry load 66 along the rotational axis of the drum 14. Thus, the controller 22 may be configured to actuate the axial drive mechanism 16 to redistribute the laundry 66 within the drum 14 in response to at least one of a laundry unbalance condition and a tangled laundry condition.

The controller 22 also may be a combination of a machine controller 21 and motor controller 23 within one physical location or a practical implementation may require their physical separation. The type and configuration of the controller 22 are not germane to the invention. Any suitable control system capable of outputting control signals to the motor 18 and to the axial drive mechanism 16 may be used.

The drum 14 and the laundry load 66 in the drum collectively define a system mass having a resonance frequency and the axial drive mechanism 16 may reciprocate at a rate sufficiently close to a natural frequency of the system to initiate the excitation of a resonance response. In the case of the drum oscillation (directions C and D) at the resonance frequency, a smaller amount of force is required to reach greater amplitude of the drum oscillation. The resonance of the system may occur at a natural frequency that is higher than the predetermined operating speed of the drum 14. For the drum size of 580 mm the resonance frequency may be a frequency of about 1.5 to 20 hz.

Other implementations of the axial drive mechanism 16 or the linear driver motor 62 may be adapted and applicable for the present invention. A spring mechanism coupled to the drive shaft 32 for oscillating the drum 14 in the directions C and D is one non-limiting example. A piston action mechanism reciprocating the drum 14 in the directions C and D is another non-limiting example. Alternatively, a direct drive motor 17 capable of generating both a motor torque and a linear movement of the drum 14 may be implemented to operate as the axial drive mechanism 16 and the motor 18. In this case, the motor 17 may have a stator and a rotor configured for both rotation about the horizontal axis of rotation and axial reciprocation relative to the horizontal axis of rotation. It will be understood, that it is within the scope of the present invention to use other types of axial drive mechanism 16 to enable linear reciprocations of the drum 14.

The previously described washing machine 10 provides the structure necessary for the implementation of a method of treating laundry in a laundry treating appliance. According to a fourth embodiment, a method may comprise rotating the drum 14 about the axis of rotation O and reciprocating the drum axially along the axis of rotation O. As described above, the axis of rotation O may be a horizontal axis or an axis inclined relative to the horizontal axis.

According to this method, the drum 14 may be selectively rotated at a predetermined rotational rate or reciprocated at a predetermined reciprocation rate. The selective rotating and reciprocating the drum may be done by alternating between rotating and reciprocating the drum 14. Alternatively, the drum 14 may be simultaneously rotated at a predetermined rotational rate and reciprocated at a predetermined reciprocation rate. The rotational rate may be a tumbling rate and the rotational direction of the drum 14 may be alternated between a first rotational direction and a second rotational direction, opposite the first rotational direction. The reciprocation rate may be a sliding rate and the sliding rate may correspond to a natural frequency of the laundry load 66.

The method may also have a redistributing action applied before any or each phase of the laundry treating cycle (wetting, washing, rinsing, spinning, drying, revitalizing, etc.). The redistributing action may be accomplished by reciprocation of the drum 14, reversing direction of drum rotation or by a combination thereof.

The method may further be actively responsive to at least one of a laundry unbalance condition and a tangled laundry condition by reciprocating the drum 14 to redistribute the unbalance or tangled laundry load 66. A method and a system for performing determination of the laundry unbalance and/or tangled conditions are not germane to the invention. Any suitable method and system capable of indicating the laundry unbalance and/or tangled conditions may be used.

There are other benefits of the present invention in addition to the improved mechanical action, the reduced likelihood of laundry unbalance and/or tangling conditions and the active step of laundry load redistribution described above. Some other benefits of the added reciprocation action may include, but are not limited to: more effective and uniform wetting process due to better mixing of a wash fluid and the laundry and more effective rinsing process due to better extraction of the wash fluid from the laundry.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a drum defining a treating chamber for receiving laundry and rotatable about a horizontal axis of rotation;

an electric motor coupled to the drum to rotate the drum about the horizontal axis of rotation;

an axial drive mechanism coupled to the drum to axially reciprocate the drum along the horizontal axis of rotation; and a controller coupled with the axial drive mechanism, the controller configured to control an axial reciprocation of the drum along the horizontal axis of rotation.

2. The laundry treating appliance of claim 1 wherein the controller is configured to control the electric motor to rotate the drum at a tumbling frequency about the horizontal axis of rotation, where laundry in the treating chamber will tumble, and the controller is configured to control the axial drive mechanism to axially reciprocate the drum axially at a reciprocation frequency.

3. The laundry treating appliance of claim 2 wherein the controller is configured to control the reciprocation frequency to be greater than the tumbling frequency.

4. The laundry treating appliance of claim 2 wherein the controller is configured to control the reciprocation frequency to be great enough that the axial reciprocation of the drum applies an axial shear force to the laundry having a magnitude greater than a frictional force between the laundry and the drum.

5. The laundry treating appliance of claim 2 wherein the controller is configured to control the reciprocation frequency to correspond to a frequency at which a small amount of applied force causes a large amplitude of drum oscillation.

6. The laundry treating appliance of claim 1 wherein the axial drive mechanism comprises a second electric motor having a stator and a rotor configured for both rotation about the horizontal axis of rotation and axial reciprocation along the horizontal axis of rotation.

7. The laundry treating appliance of claim 6, wherein the second electric motor further comprises an auxiliary winding configured to axially reciprocate the rotor.

8. The laundry treating appliance of claim 6 wherein the rotor is coupled with the drum via a drive shaft.

9. The laundry treating appliance of claim 1 wherein the axial drive mechanism comprises a linear motor coupled with the axial drive mechanism and configured to actuate the axial drive mechanism to axially reciprocate the drum along the horizontal axis of rotation.

10. The laundry treating appliance of claim 9 wherein the controller is configured to at least one independently or simultaneously control both the electric motor and the linear motor to at least one of independently or simultaneously rotate and reciprocate the drum about and/or along the horizontal axis of rotation.

11. The laundry treating appliance of claim 1 wherein the controller is configured to at least one independently or simultaneously control both the electric motor and the axial drive mechanism to at least one of independently or simultaneously rotate and reciprocate the drum about and/or along the horizontal axis of rotation.

12. The laundry treating appliance of claim 1 wherein the controller is configured to actuate the axial drive mechanism to redistribute the laundry within the drum in response to at least one of a laundry unbalance condition or a tangled laundry condition.

13. The laundry treating appliance of claim 1 wherein at least a portion of the drum defining a treating chamber further comprises a textured surface configured to increase a mechanical action applied to the laundry by the axial reciprocation of the drum.

* * * * *